US010946539B2

(12) United States Patent
Nijdam

(10) Patent No.: US 10,946,539 B2
(45) **Date of Patent: *Mar. 16, 2021**

(54) HAIR CUTTING APPARATUS COMPRISING A LIGHT INDICATOR

(71) Applicant: KONINKLIJKE PHILIPS N.V., Eindhoven (NL)

(72) Inventor: Jeroen Christian Nijdam, Eelderwolde (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/465,594

(22) PCT Filed: Dec. 1, 2017

(86) PCT No.: PCT/EP2017/081184

§ 371 (c)(1),
(2) Date: May 31, 2019

(87) PCT Pub. No.: WO2018/100155

PCT Pub. Date: Jun. 7, 2018

(65) Prior Publication Data

US 2020/0180176 A1 Jun. 11, 2020

(30) Foreign Application Priority Data

Dec. 1, 2016 (EP) ..... 16201829

(51) Int. Cl.
*B26B 19/38* (2006.01)
*B26B 19/46* (2006.01)

(52) U.S. Cl.
CPC ..... *B26B 19/388* (2013.01); *B26B 19/46* (2013.01)

(58) Field of Classification Search
CPC ..... B26B 19/388; B26B 19/46
See application file for complete search history.

(56) References Cited

U.S. PATENT DOCUMENTS

| | | | | |
|---|---|---|---|---|
| 5,165,170 | A | 11/1992 | Sagol | |
| 5,367,599 | A | 11/1994 | Okada | |
| 5,687,481 | A | 11/1997 | De Boer | |
| 6,072,399 | A | 6/2000 | Cimbal | |
| 6,634,104 | B2 | 10/2003 | Jacobsen | |
| 8,943,635 | B2 | 2/2015 | Heil | |
| 8,988,918 | B2 | 3/2015 | Luckel | |
| 2014/0345142 | A1* | 11/2014 | Damkat | B26B 21/405 30/34.2 |
| 2015/0126981 | A1* | 5/2015 | Verghese | B26B 19/00 606/9 |
| 2016/0167241 | A1 | 6/2016 | Goldfarb | |
| 2017/0156796 | A1* | 6/2017 | Moeskops | B26B 19/388 |
| 2019/0275687 | A1* | 9/2019 | Nijdam | B26B 19/388 |
| 2020/0033448 | A1* | 1/2020 | Bourquin | G01S 7/4816 |
| 2020/0156272 | A1* | 5/2020 | De Vries | B26B 19/145 |

FOREIGN PATENT DOCUMENTS

JP 2010227226 A 10/2010

* cited by examiner

*Primary Examiner* — Omar Flores Sanchez

(57) ABSTRACT

A hair cutting apparatus, such as a shaver, includes a cutting detector to actually detect any hair-cutting actions of the hair cutting apparatus. The apparatus further includes a cutting indicator having a light indicator configured and controlled by the cutting detector to be instantaneously activated when the cutting detector actually detects a hair-cutting action.

20 Claims, 5 Drawing Sheets

HAIR CUTTING APPARATUS COMPRISING A LIGHT INDICATOR

This application is the U.S. National Phase application under 35 U.S.C. § 371 of International Application No. PCT/EP2017/081184, filed on Dec. 1, 2017, which claims the benefit of European Application No. 16201829.5, filed on Dec. 1, 2016. These applications are hereby incorporated by reference herein.

FIELD OF THE INVENTION

The invention relates to a hair cutting apparatus comprising a cutting element, a motor, a hair-cutting detector and a cutting indicator. The invention also relates to a method of indicating a hair-cutting process of a hair cutting apparatus.

BACKGROUND OF THE INVENTION

Such hair cutting apparatuses are known and include shaving devices and grooming devices. Such hair cutting apparatuses may have a sensor to sense whether the apparatus, in particular the cutting element thereof, is actually cutting hair. The sensing results can be used to control the hair cutting apparatus. One possibility to identify actual hair-cutting actions of the cutting element is to detect current peaks of the motor current. The motor current, i.e. the current powering the motor driving the cutting element, usually sharply rises whenever a hair is being cut.

Furthermore, every day shaving is quite monotonous, and any identifying of whether hair is being cut might not change that. Use can be made of a known razor issuing an audible signal indicating the surface quality of the skin being shaved. However, such audible signal might become quite annoying.

U.S. Pat. No. 6,634,104 B2 discloses a shaving device comprising a processor or intelligent analysis unit that receives a shaving signal and determines what shaving changes should be made. An audible indicator is coupled to the processor to inform the user of the shaving changes needed.

U.S. Pat. No. 5,165,170 discloses a razor having an integral hair cutting detecting means and an audio frequency amplifying means. In use, the user hears amplified vibrations of the cutting blade of the razor as a form of feedback relating to the surface quality of the skin being shaved.

SUMMARY OF THE INVENTION

In view of the above mentioned problems, a general object of the present invention is to provide an improved hair cutting apparatus and an improved method of indicating a hair-cutting process of a hair cutting apparatus. In particular, an object of the invention is to provide the hair cutting apparatus with an improved solution to inform the user about the status of the hair-cutting process. It is in particular an object to provide the user with a more intuitive and easy-to-understand indication of the progress of the hair-cutting or shaving process.

According to a first aspect of the invention, a hair cutting apparatus comprises a cutting element configured to cut hair, a motor configured to drive the cutting element for cutting the hair when powered by a motor current, a hair-cutting detector configured to detect a hair-cutting action of the cutting element, and a cutting indicator configured to indicate a detected hair-cutting action of the cutting element, wherein the cutting indicator comprises a light indicator controlled by the hair-cutting detector and configured to be activated to instantaneously indicate whether a hair-cutting action of the cutting element is actually detected by the hair-cutting detector.

The hair cutting apparatus can be a shaving device, a grooming device, or any other device for cutting hair. Any following explanations with respect to a shaver or shaving device also relate to any other hair cutting apparatus or any other action of hair cutting. The cutting element can be an oscillating cutting element, a linearly reciprocating cutting element, or a rotating cutting element comprising one cutting blade or a plurality of cutting blades or similar means for cutting hair. The hair-cutting detector may comprise a sensor and circuitry to sense and evaluate a motor current of the motor driving the cutting element of the device, but alternative hair-cutting detectors may be used as well, such as sensors and circuitry to sense and evaluate acoustic signals generated by the hair-cutting process. Another suitable hair-cutting detector comprises a sensor and circuitry to sense and evaluate vibrations caused by the cutting element when moving over the skin surface.

According to the invention, the activation of the light indicator is controlled by the hair-cutting detector, and the light indicator is instantaneously activated when the hair-cutting detector actually detects a hair-cutting action of the cutting element. In particular, the light indicator is switched on or off depending on whether or not the hair-cutting detector actually detects a hair-cutting action of the cutting element. In this way, the user, while shaving, immediately recognizes whether hair is actually being cut or not. Based on this information, the user can e.g. continue shaving a particular area of the skin or he may be prompted to move the device to another area of the skin. In particular, the light indicator may stay off when no hair-cutting actions are actually being detected, and this will prompt the user to move the device to another area of the skin or to finish the shaving process.

Accordingly, hair-cutting actions of the cutting element are instantaneously detected and, depending on that, the light indicator or part of it can be instantaneously activated to indicate the detected hair-cutting actions. In this way, the actual hair-cutting actions by the cutting element are indicated to the user. Any hair-cutting actions detected are instantaneously indicated by the light indicator. In particular, such a light indicator is activated, in particular switched on, when the hair-cutting detector detects that a hair is being cut. One possible way to indicate such a hair-cutting action is to switch on the light indicator and keep it switched on for a short time period, such as for one second or part of a second. In this way, the user of the hair cutting apparatus according to the invention can easily realize whether hair is actually being cut or not. The use of such a light indicator has the advantage of providing an easy and intuitive way of indicating whether hair is being cut or not. This way the user is better aware of the actual operational status of the hair cutting apparatus. Because the hair cutting process by itself produces noise, the light indicator provides additional information or help for the user to identify the operational status of the hair cutting apparatus. For example, if the hair cutting apparatus is a shaving device, the user can easily identify regions on the skin where further shaving is needed.

It was also found that using a light indicator to indicate whether a hair is currently being cut or not limits the negative influence of the changing or predominant sound or noise of the shaver, i.e. the natural sound of the shaver, such as the sound of the motor and any sound from the cutting action. In comparison to e.g. a solution providing amplified vibrations of the cutting element as an audible feedback, using a light indicator avoids the generation of any additional sound. Accordingly, as regards the sound, the user uses the shaver in his normal way, but the light indicator provides a completely different signal and, thus, provides completely different and additional information, without changing the existing sound characteristics of the shaver. This is just an example relating to a shaver, but it may also relate to other kinds of hair cutting apparatuses.

In an embodiment of the hair cutting apparatus according to the invention, the light indicator is arranged in the proximity of the cutting element. Usually, during shaving, the user looks at the cutting element, in particular at a cutting head of the hair cutting apparatus in order to see where he is shaving. By placing the light indicator in the proximity of the cutting element, the user will also basically automatically see the light indicator as well. In this way, the additional information provided by the light indicator of whether hairs are actually being cut or not can easily be provided to the user by placing the light indicator in the proximity of the cutting element.

In an embodiment of the hair cutting apparatus according to the invention, the light indicator has the shape of a partial ring. The light indicator is preferably provided as a C-shaped light indicator. This embodiment enables the light indicator to partially surround the hair cutting apparatus or the cutting element thereof. With such a shape, the light indicator can be provided in an area of the hair cutting apparatus which is particularly in the line of sight of the user. Phrased simply, the light indicator can be placed on an upper half of a casing of the hair cutting apparatus, facing towards the eyes of the user during shaving. By using a partial ring, in particular a C-shaped ring, the light indicator can form part of one shell of the casing, in particular when the casing basically comprises two shells of a similar size, in particular two half shells.

In an embodiment of the hair cutting apparatus according to the invention, the hair cutting apparatus comprises a progress determining unit for determining a status of progress of a hair-cutting process based on the detected hair-cutting actions. One possibility is to count the detected hair-cutting actions during a predefined time interval. With ongoing progress of a hair-cutting process, less hair-cutting actions will be detected during such a time interval.

In an embodiment of the hair cutting apparatus according to the invention, the light indicator is adapted to be activated in different colors, at least in mutually different first and second colors, and the hair-cutting detector is adapted to control the light indicator such that the first color is instantaneously generated when a hair-cutting action is detected and the second color is instantaneously generated when no hair-cutting action is detected. In this way, the color generated by the light indicator informs the user about the actual hair-cutting process, for example the shaving process. At the beginning of a shaving session, the first color will be predominantly generated as long as hairs are being cut. Towards the end of the shaving session, the second color will be generated to an increasing extent. Alternatively, more than two colors may be generated and, in a particular embodiment, also a third color may be generated. The underlying idea is that, when hair-cutting actions are detected, it is suggested to provide a further and more detailed indication, such as an indication of the amount of hairs being cut, e.g. during a predetermined time interval. For that purpose, at least a third color could be used.

If the progress of a shaving session is shown on a scale from 0%, when the shaving session is started, to 100%, when no hair-cutting actions are being detected anymore, the first color can correspond to and indicate approximately 0% to 33% of the progress, whereas the second color can correspond to and indicate approximately 33% to 66% of the progress, and the third color can correspond to and indicate approximately 66% to 100% of the progress. Using this scale, 0% can refer to an average value of a cutting process indicating the start of a shaving session. In an embodiment, 0% of a progress of a shaving session can refer to a certain number of hairs cut per second. The scale of 0% to 100% can also in general refer to said number of hairs cut per second.

In an embodiment of the hair cutting apparatus according to the invention, the hair-cutting detector is configured to provide a fading function for the light indicator, enabling light generated by the light indicator to gradually change from the first color to the second color when the hair-cutting detector detects a decreasing number of hairs being cut during a predetermined time interval. It is thus e.g. achieved that the light indicator gradually changes from the first color to the second color to indicate a transition from a condition wherein hairs are being cut to a condition wherein no hairs are being cut. In particular, the first color fades out when no hairs are being cut anymore and, concurrently, the second color fades in. In this way, with ongoing progress of shaving, the end of a shaving session is indicated by the color of the light indicator fading from the first color to the second color.

The light indicator may comprise a plurality of light elements, in particular a plurality of LEDs. Multiple color light elements, in particular multiple color LEDs, can be used and, for fading from a first color to a second color, further colors can be used in between. To give one example, the color could change from red to blue and turn violet in between.

In an embodiment of the hair cutting apparatus according to the invention, the light indicator comprises a plurality of light elements, and the progress determining unit is adapted to individually control the light elements to indicate a status of progress of the hair-cutting process by a number of light elements being activated. Such light elements, in particular LEDs, can be arranged as a bar, in particular as a partial ring, being particularly arranged in the proximity of a cutting element. Such a bar can indicate the progress of the hair-cutting process by activating more and more light elements, in particular LEDs, as the progress of cutting hair moves from 0% to 100%, or the other way around. In this way, the progress of the hair-cutting process is made visible by a light bar.

Accordingly, the light indicator can be activated at least by means of one of the light elements when hair-cutting actions of the cutting element are actually being detected, and all light elements can be switched off when no hair-cutting actions are actually being detected. But when hair-cutting actions are detected, it is suggested to provide a further and more detailed indication of the hair-cutting process. This can simply be done by activating more or fewer light elements, depending on how many or how often hair-cutting actions are actually being detected. One way of detecting such information is to count the number of detected hair-cutting actions during a predefined time interval.

In an embodiment of the hair cutting apparatus according to the invention, the light indicator is adapted to blink to indicate that no hair-cutting action is actually being detected. In this way, the end of a hair-cutting process, in particular the end of a shaving session, can be indicated quite easily. The light indicator can be activated without blinking as long as hairs are actually being cut, and can change to the blinking state when no hair cutting is actually being detected anymore. The activated light indicator indicates that the shaving apparatus is operating normally, and changes to the blinking state to indicate that the shaving process is completed. Alternatively, the light indicator is switched off when the apparatus operates normally, and only switches from off to blinking towards the end of the shaving session.

In an embodiment of the hair cutting apparatus according to the invention, the hair-cutting detector comprises a current detector configured to detect the motor current as a function of time, wherein the current detector comprises a current sensor configured to sense the motor current and provide a current signal indicative of the sensed motor current, and a current manipulator configured to determine a time derivative signal of the current signal, wherein the current manipulator comprises an evaluator configured to detect whether the time derivative signal or an amplified signal of the time derivative signal is above a predetermined threshold value to detect a hair-cutting action of the cutting element.

The motor is mechanically connected to the cutting element, e.g. to said oscillating cutting element or said rotating cutting element. This connection can be either directly or through the use of a drive shaft or other mechanical connection. In order to run the motor, the motor is powered by a motor current. This motor current is detected by the current detector as a function of time. The current detector comprises at least a current sensor and a current manipulator. The current sensor senses the motor current and provides a signal indicative of the sensed motor current. One possibility to do so is to use a sense resistor through which the motor current flows, and to measure the resulting voltage across this sense resistor. This measured voltage, according to this example, forms the current signal, as this voltage is indicative of the sensed motor current, i.e. this voltage is basically proportional to the motor current.

The current manipulator determines a time derivative signal of the current signal. Accordingly, the current signal is differentiated with respect to time to determine said time derivative signal. In this way, small, yet sudden, changes of the current signal which are associated with hair-cutting actions by the cutting element will become dominant in the differentiated signal.

The time derivative signal or an amplified signal of the time derivative signal is compared with a predetermined threshold value to detect whether a value of the time derivative signal is above the predetermined threshold value in order to identify a hair-cutting action of the cutting element. Said comparison is done by a circuitry, or it could also be calculated by means of a microprocessor, i.e. the evaluator can be implemented as a circuitry or in a microprocessor.

Accordingly, the detection of a hair-cutting action is not based on the absolute value of the motor current, but on the time derivative of the absolute motor current. The time derivative is compared with a predetermined threshold value. This makes the detection particularly robust to changes of the properties of the shaver, such as wear or soiling. Of course, the time derivative of the motor current can also be amplified before being compared with the threshold.

In an embodiment of the hair cutting apparatus according to the invention, the current manipulator comprises a first high-pass filter adapted to determine the time derivative signal of the current signal. The first high-pass filter may comprise a series capacitor, in particular when the current signal is represented by a corresponding voltage. When the motor current is constant, i.e. if the voltage representing the motor current is constant, no current will result at this capacitor. Only changes in the motor current signal, i.e. changes in the voltage at the capacitor, result in an output at the capacitor. The capacitor differentiates the current signal, i.e. the voltage representing the motor current as a function of time. Accordingly, the differentiation dI/dt of the current signal is performed, with "I" indicating the current signal in general and "t" indicating time. The use of the letter "I" is only for explanation and the current signal could also be provided as a voltage. The differentiation may alternatively be done by a circuitry, or it could also be calculated by means of a microprocessor once the current signal is digitized.

In an embodiment of the hair cutting apparatus according to the invention, the hair cutting apparatus comprises a drive system coupling the motor to the cutting element, and the current manipulator comprises a first low-pass filter configured to eliminate high frequency components of the current signal caused by torque changes of the drive system. Such torque changes of the drive system coupling the motor to the cutting element can cause frequency components in the motor current, and thus in the current signal, which are higher than the frequency components which might be caused by hair-cutting actions of the cutting element. The first low-pass filter is thus tailored to such higher frequency components. The filter cutoff frequency can be in a −3 dB range of 2 Hz to 20 Hz. The first low-pass filter is thus also designed to eliminate high frequency components in the current signal due to commutation of the motor current, and also to eliminate high frequency components due to torque changes produced by the drive train and shaving system. Such torque changes can also be understood as noise due to their characteristic frequency range.

In an embodiment of the hair cutting apparatus according to the invention, the first high-pass filter has a differentiating character for specific frequency ranges. In these specific frequency ranges the first high-pass filter differentiates the current signal and passes through current changes of the current signal. The first high-pass filter is thus tailored to a frequency range configured to pass through current changes of the current signal. The first high-pass filter differentiates these current changes, and in this way the evaluation of the current signal can be performed or improved. The changes of the current signal depict changes of the motor current rising to a higher value or falling to a lower value. Effects, which are particularly related to hair-cutting actions of the cutting element, appear in a lower frequency range than the signal characteristics which were to be filtered with the first low-pass filter according to the embodiment described hereinbefore. Nevertheless, the filter cutoff frequency of the first high-pass filter can just as well be in a −3 dB range of 2 Hz to 20 Hz.

This first high-pass filter and the first low-pass filter described hereinbefore can also be combined, even with similar frequency ranges. Combining these two filters may result in a band-pass filter passing through particular characteristics of the current signal or the motor current, respectively, indicative of the hair-cutting actions of the cutting element.

In particular, the first high-pass filter is designed to pass through only the current changes. It is designed in such a way that its output will be zero when there are no current changes. For setting the predetermined threshold value for detecting signal characteristics associated with hair-cutting actions of the cutting element, the first high-pass filter has a time-differentiating effect resulting in a time-differentiated current signal. The time-differentiated current signal, which can thus be a differentiated voltage, will be easier to observe. It is easier to compare such a time-differentiated current signal with a predefined detection threshold and, thus, it is easier to set such a predetermined threshold value. The reason is that this differentiating effect of the high-pass filter results in a signal having no DC bias. In particular there is no DC bias between multiple circuits. Accordingly, the absolute motor current or the corresponding current signal is not present anymore in this signal filtered by the first high-pass filter, i.e. differentiated by the first high-pass filter. Accordingly, the current manipulator processes basically only such changes which are associated with hair-cutting actions of the cutting element. This could be defined by a frequency range for the changes of the current signal of about 1 to 40 Hz, in particular 2 to 20 Hz.

In particular, any noise of the motor current or of the current signal indicative of the motor current is not used to detect any hair-cutting actions, but preferably such noise is reduced or eliminated. Certain characteristic changes in the motor current or changes in the current signal, respectively, are taken into account when designing the current manipulator such that only these characteristic changes are considered and used.

In an embodiment of the hair cutting apparatus according to the invention, the current manipulator comprises an operational amplifier configured to amplify the time derivative signal into an amplified signal, and the current manipulator comprises a second high-pass filter configured to differentiate the amplified signal to eliminate a DC-offset of the amplified signal. By using said operational amplifier any decreases of the amplitude of the current signal due to any filtering can at least be compensated. In general, the operational amplifier can amplify the filtered signal and thus only the characteristics of the current signal which are of interest. The process of differentiating the amplified signal aims at eliminating a DC-offset of the amplified signal. An amplified signal, being the output of an operational amplifier, might comprise a DC-offset. For evaluating the current signal or the filtered current signal in order to identify hair-cutting actions, absolute values of such a signal are of less interest; only particular characteristics of this signal are of interest in order to identify hair-cutting actions of the cutting element. Therefore, a DC-offset is not wanted or at least not helpful. The second high-pass filter has a time-differentiating effect and can thus eliminate the DC-offset by time-differentiating the amplified signal. The second high-pass filter can be combined with the operational amplifier.

In an embodiment of the hair cutting apparatus according to the invention, the first low-pass filter or the first high-pass filter according to the above-mentioned embodiments or both filters are integrated into the operational amplifier. In this way, the use of at least one of these filters provides a filtered signal basically comprising only the characteristics of interest of the current signal. Such a filtered and thus improved signal is amplified by the operational amplifier and the amplified signal is then adapted to be detected or evaluated more easily.

In an embodiment of the hair cutting apparatus according to the invention, the current manipulator comprises a second low-pass filter configured to eliminate residual high frequent noise of the amplified signal. In this embodiment, it is assumed that the operational amplifier, which could be an operational amplifier according to any of the above described embodiments, provides, as the amplified output signal, an improved signal basically comprising time-derivatives associated with hair-cutting actions of the cutting element. However, this amplified signal might still comprise residual high frequent noise. The second low-pass filter is particularly used to eliminate or at least reduce such high frequent noise. The second low-pass filter is preferably set to a −3 dB range of 30-50 Hz. It was found that this frequency range is well suited to eliminate the described residual high frequent noise.

The second high-pass filter according to at least one previously mentioned embodiment and the second low-pass filter could also be combined into a single band-pass filter. Accordingly, the current detector could be provided with the second high-pass filter, or the second low-pass filter, or both said filters, possibly combined as a single band-pass filter. At least one of these filters is connected at least to an output of the operational amplifier as explained according to at least one of the above described embodiments.

The resulting output signal provided by any of these explained embodiments can be a filtered and/or amplified current signal basically only comprising time-derivatives related to hair-cutting actions of the cutting element. Such an output signal can be detected or evaluated in particular by comparing it with the predetermined threshold value.

In an embodiment of the hair cutting apparatus according to the invention, the evaluator is configured to associate an occurrence of a value of the time derivative signal or the amplified signal being greater than the predetermined threshold value with a hair-cutting action of the cutting element. The evaluator may instantaneously provide an output signal, indicating a hair-cutting action, when the evaluator establishes that the time derivative signal or the amplified signal is greater than said predetermined threshold value. Accordingly, the time derivative signal or the amplified signal is compared with the predetermined threshold value, and any values thereof exceeding the threshold value indicate that a hair is actually being cut. In this way, a simple, effective and, in particular, robust way of evaluating the processed current signal is achieved. The processed current signal is basically the result of at least one of the filters and the operational amplifier according to at least one embodiment explained above. Accordingly, the processed current signal is a time derivative of the current signal and basically comprises only the characteristic components of the current signal of interest, namely the characteristic components associated with hair-cutting actions of the cutting element.

The time derivative signal or the amplified signal can easily be evaluated with respect to whether a hair-cutting action is actually being performed by the cutting element. Basically, the amplitude of the current signal is not of interest. However, the current signal will in particular comprise peaks associated with the hair-cutting actions of the cutting element. According to the invention, such peaks are detected by determination of the time-derivative of the current signal. This will eliminate any DC components in the current signal, so that the peaks can easily be compared with the predetermined threshold value without being hampered by any DC components. It was found that such an evaluation is robust to slow motor torque changes due to wear, pollution or other influences.

In an embodiment of the hair cutting apparatus according to the invention, the current sensor is provided as an analogue electric circuitry, the current manipulator is provided as an analogue electrical circuitry comprising an operational amplifier, and the evaluator is provided as a digital processor. In this embodiment, the evaluator is configured to evaluate a processed current signal being an output signal of the current manipulator.

Accordingly, the current sensor and the current manipulator prepare the sensed signal in an analogue way to provide said processed signal. In particular, the circuitry provides a processed signal which basically only comprises characteristics of a time-differentiated signal associated with hair-cutting actions of the cutting element. Such a processed signal can be input into a microprocessor, after having been digitized by an A/D-converter. Alternatively, such an A/D-converter is part of the microprocessor. The comparison of this processed signal with the predetermined threshold value can be done by the microprocessor and the result can be used for various applications. In particular, it can be used to provide an indication of the actual occurrence of hair-cutting actions of the cutting element.

However, according to another embodiment it is also possible to perform the evaluation in a different way. One possibility is to use, instead of the microprocessor, an operational amplifier provided as a comparator. Accordingly, it is also possible to finally evaluate whether any hair-cutting actions are actually performed by the cutting element by using an analogue evaluator, in particular any kind of suitable electric circuitry.

Alternatively, at least the current manipulator and the evaluator can also be provided in a digital manner. In particular the high-pass filters and low-pass filters described above can be realized as digital filters.

According to a second aspect of the present invention, a method is provided for indicating a hair-cutting process of a hair cutting apparatus according to the first aspect of the present invention, comprising the steps of detecting actual hair-cutting actions of the cutting element by means of a cutting detector, and instantaneously activating the light indicator when the cutting detector actually detects a hair-cutting action of the cutting element.

According to this method, hair-cutting actions of the cutting element are detected by means of a cutting detector. Said detection can be done by evaluating the motor current, in particular by determining a time-derivative of a current signal indicative of the motor current. Said detection could also be done by comparing the amplitude of the motor current with a threshold value. Another possibility is to detect hair-cutting actions by directly measuring a torque of a shaft of the motor. The detection of hair-cutting actions might also be possible by evaluating characteristic features of a sound signal generated by the hair-cutting actions, said characteristic features being associated with hair-cutting actions by the cutting element.

The result of said detection is used to activate a light indicator. In particular, the light indicator is instantaneously activated when hair-cutting actions are actually detected by the cutting detector.

The method according to the invention is particularly useful for use with a hair cutting apparatus according to any of the embodiments described before. In this way, the hair cutting apparatus is able to provide the user with information about the status of a hair-cutting process in a very intuitive and useful way.

In an embodiment of the method of indicating a hair-cutting process according to the invention, for detecting a hair-cutting action of the cutting element the method comprises the steps of sensing the motor current of the motor by using a current sensor and providing a current signal as a function of time indicative of the sensed motor current, determining a time derivative signal of the current signal using a current manipulator, and detecting whether the time derivative signal or an amplified signal of the time derivative signal is above a predetermined threshold value to detect a hair-cutting action of the cutting element, using an evaluator, and the method further comprises the steps of eliminating high frequency components of the current signal caused by torque changes of a drive system coupling the motor to the cutting element by using a first low-pass filter providing a first filtered signal, determining a time derivative signal of the first filtered signal by using the first high-pass filter, amplifying the time derivative signal into an amplified signal by using an operational amplifier, differentiating the amplified signal by using a second high-pass filter to eliminate a DC-offset of the amplified signal, and eliminating a residual high frequent noise of the differentiated amplified signal by using a second low-pass filter to provide a processed current signal. In this embodiment, the light indicator is activated based on this processed signal. All of the steps of this embodiment of the method according to the invention can be performed by means of a hair cutting apparatus according to at least one of the above-explained embodiments, in particular by using at least one of the above-described first and second high-pass filters, first and second low-pass filters, and an operational amplifier. These steps are performed in a way described above with respect to said embodiments, and they have the advantages as explained with respect to said embodiments.

Preferably, the parts of the hair cutting apparatus detecting and evaluating the motor current in order to detect any hair-cutting actions of the cutting element can be provided in a way as described in the above-explained corresponding embodiments of a hair cutting apparatus, and the method according to the invention can be performed as explained hereinbefore for any method performed by any of the corresponding embodiments of the hair cutting apparatus as described hereinbefore.

These and other aspects of the invention will be apparent from and elucidated with reference to the embodiments described hereinafter.

DETAILED DESCRIPTION OF THE EMBODIMENTS

Figure 1:
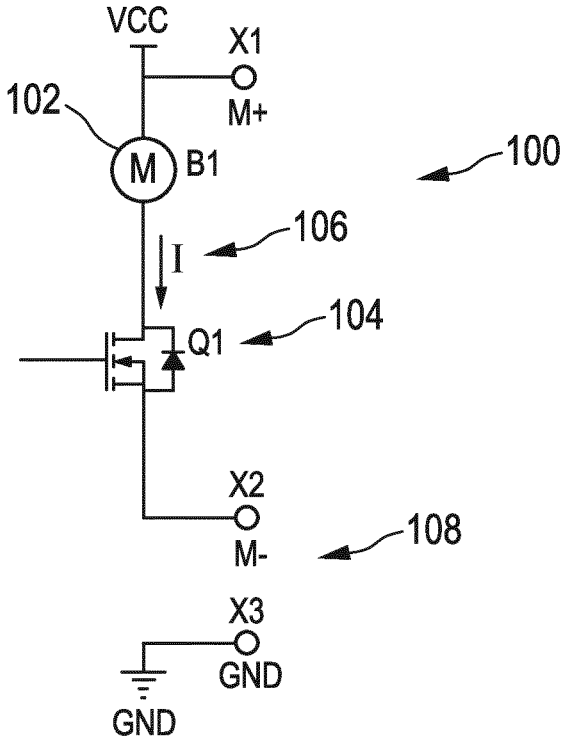
FIG. 1 is an electric circuitry of a hair cutting apparatus comprising a motor and a switch for switching.

FIG. 1 shows an electric circuitry 100 of a shaver as an example of a hair cutting apparatus. This circuitry 100 comprises a motor 102 and a switching device 104 for controlling the motor 102. A DC motor current 106, also indicated with the capital letter I, can flow through the motor 102 and the switching device 104 to an interface 108 having the connection points X2 and X3.

Figure 2:
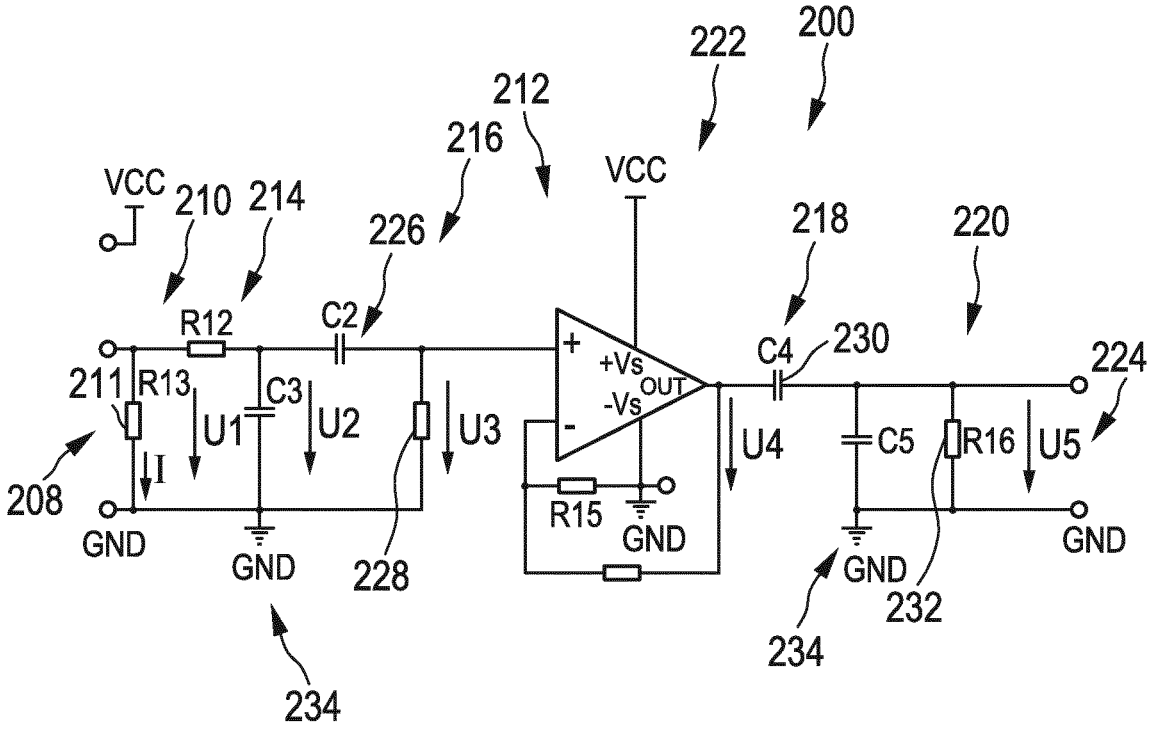
FIG. 2 is a current detector for detecting a motor current of the motor shown in FIG. 1.

The motor current 106 can be sensed and detected with the current detector 200 shown in FIG. 2, which will be connected to the connection points X2 and X3 of the interface 108 of FIG. 1.

FIG. 2 shows the current detector 200 having an interface 208 for connection to the interface 108 of the electric circuitry according to FIG. 1. Accordingly, the connection points X2 and X3 are indicated with the same letter numbers. In fact this can also be understood as a possibility of dividing the technical drawing of the circuitry into two drawings. In the same manner, the connection point X1 is also present in FIGS. 1 and 2.

The current detector 200 basically comprises a current sensor 210 and the current manipulator 212, which is basically the rest of the current detector. The current sensor 210 basically just comprises a sense resistor 211, so that there is a voltage drop U1 across this sense resistor 211 which is basically proportional to the motor current I shown as motor current 106 in FIG. 1.

The current manipulator 212 basically comprises a first low-pass filter 214, a first high-pass filter 216, a second high-pass filter 218 and a second low-pass filter 220 as well as an operational amplifier 222. The purpose of the current manipulator 212 is to provide a processed current signal U5 at the output 224 of the current manipulator 212.

The working principle of the current detector consists of a current sensing circuit, a filter circuit and an amplification circuit and can be explained using FIG. 2.

The motor current 106 is sensed at the sense resistor 211, resulting in a voltage signal U1. The voltage signal U1 is an example of a current signal indicative of the motor current. The voltage signal U1 is fed to the first low-pass filter 214 having a −3 dB frequency of 2 Hz. This low-pass filter 214 eliminates all high frequency components due to commutation, but also high frequency components due to torque changes, which basically appear as noise produced by the drive train and shaving system.

The output of the first low-pass filter 214 is fed into a series capacitor 226 of the first high-pass filter 216. The series capacitor 226 acts to time-differentiate the voltage signal U2 which is the output of the first low-pass filter 214. The filter cutoff frequency of the first high-pass filter 216 can be in a −3 dB range of 2 Hz to 20 Hz.

The function of this series capacitor 226 is to pass only the time derivative signal dI/dt of the signal coming from the first low-pass filter 214. The output of the first high-pass filter will be zero when there are no current changes, due to the differentiating character of the first high-pass filter.

It was found that for setting a detection threshold, this differentiated voltage U3, which is the output of the first high-pass filter 216, will be easier to use, because there is no DC bias between multiple circuits. So, the absolute motor current or an absolute current signal indicative of the motor current is not present anymore in this voltage.

A discharge resistor 228 is connected between the output of this series capacitor 226 and ground, in order to discharge the capacitor 226.

Because filtering will cause signal gain loss, the operational amplifier 222 is proposed. It is used to boost the output signal of the first high-pass filter 216, namely the voltage U3. The output voltage U4 of the operational amplifier is connected to a further series capacitor 230, which is part of the second high-pass filter 218. This further series capacitor 230, and thus the second high-pass filter 218, works as a differentiator to eliminate a DC offset which is generated by the operational amplifier 222.

This further series capacitor 230 has also a discharge resistor 232 connected between the output of the series capacitor 230 and ground 234 to discharge the further series capacitor 230, as it was found that otherwise the signal will be clipped.

The signal coming out of the series capacitor 230 will be fed into the second low-pass filter 220 to eliminate residual high frequent noise. The cutoff frequency of the second low-pass filter 220 is in the range of 30 Hz to 50 Hz.

The result of the current detector 200 and thus of the current manipulator 212 is the voltage U5 at the output 224.

Figure 5:
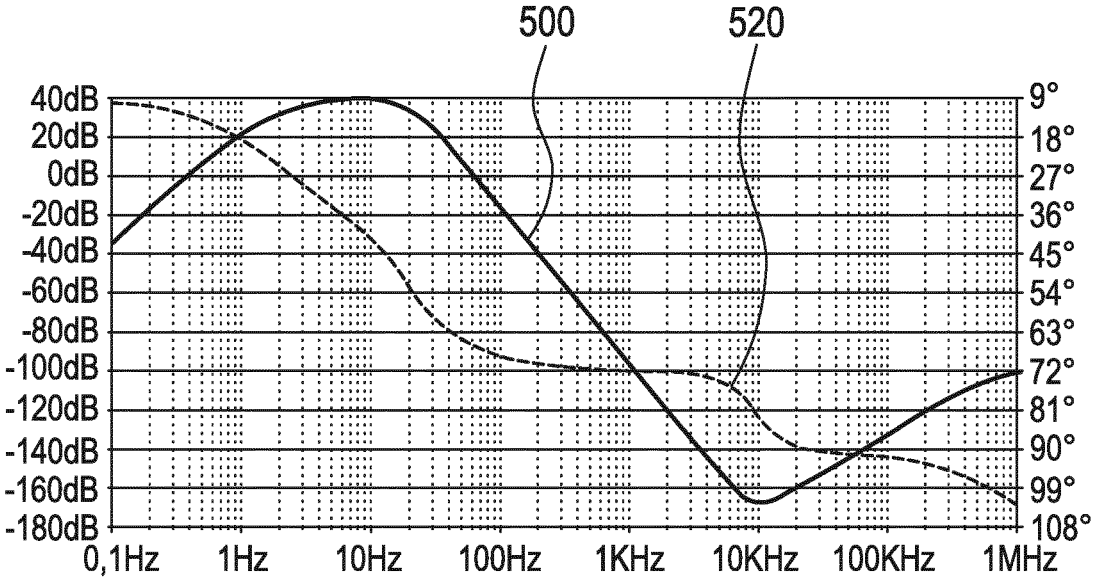
FIG. 5 is a Bode-Diagram of a current manipulator.

The total gain of the current manipulator 212 is 40 dB and therefore 100V/V. This is also illustrated in the Bode-Diagram according to FIG. 5. That Bode-Diagram shows the curve of the gain 500 in dB and the curve of the phase 520 in degrees over the logarithmic frequency. For the final evaluation purpose of the current manipulator the curve of the phase is of less interest. The curve of the gain 500 shows the highest value of about 40 dB at 10 Hz and falls to 0 dB at about 60 Hz. From 0.4 Hz to 60 Hz the gain is above 0 dB.

When contrary to the suggested principle an absolute value of the motor current is used for evaluation, the problem occurs that, when the load changes e.g. due to wear or by using a different interchangeable shaving or grooming unit, the absolute value of the motor current will change substantially. It was found that setting a threshold value for detecting peaks of such an absolute motor current will not be robust enough to handle torque changes over time, because the no-load current will change.

In view of that, the advantage of the present working principle, in particular as explained using the example of FIG. 2, is that the enhancing of the changes in the current signal associated with hair-cutting actions of the cutting element is not very sensitive to slow changes of the system and thus is robust to changes of the system. In other words, the electronics explained hereinabove automatically adapt to slow torque changes due to wear, pollution and so on.

Figure 3:
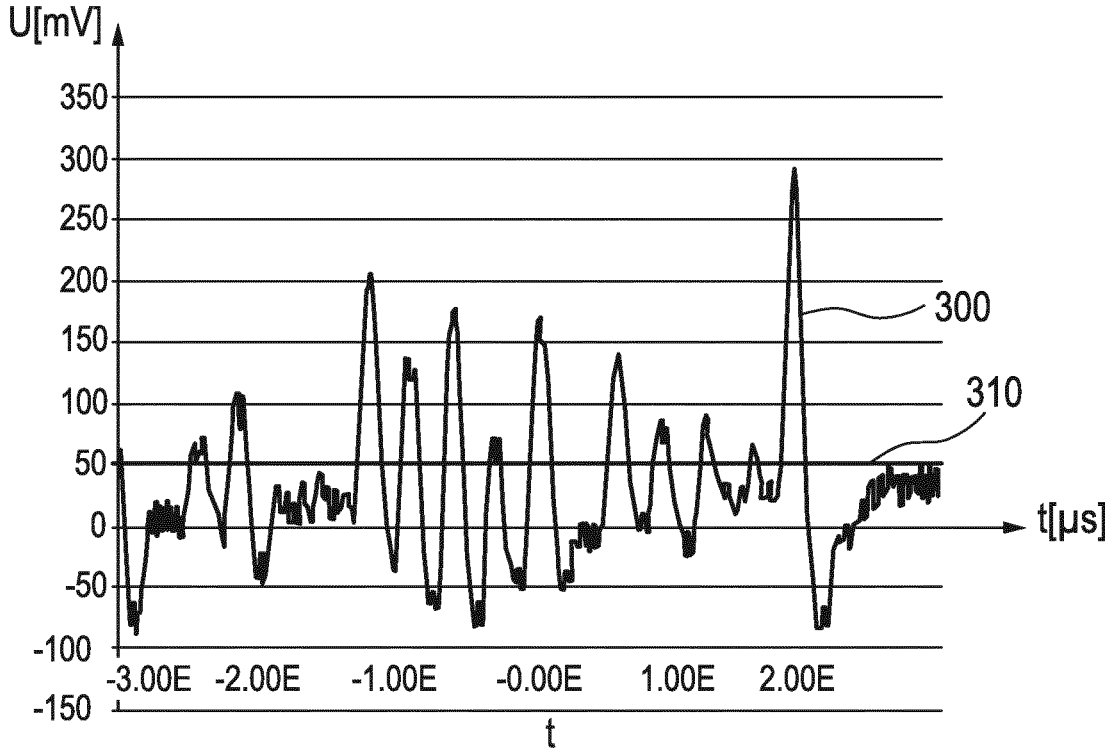
FIG. 3 is a diagram showing a processed current signal and a threshold value.
Figure 4:
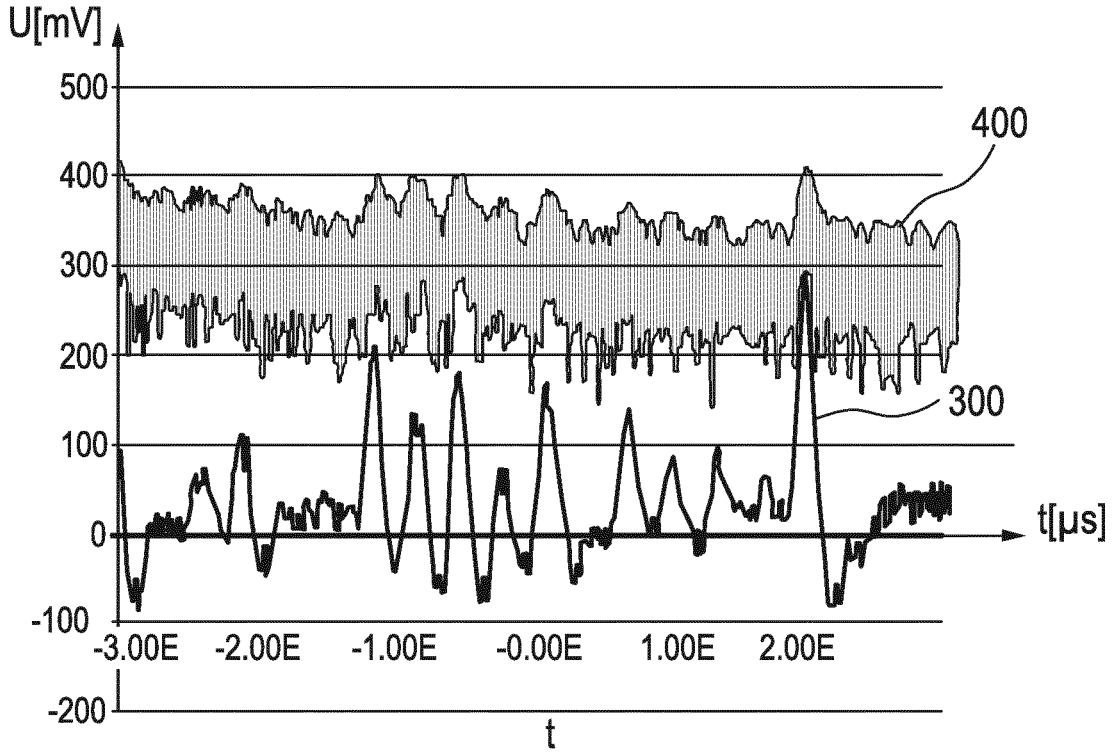
FIG. 4 is a diagram showing a processed current signal of a motor current and the motor current.

Results illustrating this are shown in FIGS. 3 and 4. FIG. 3 shows the processed current signal 300 that shows the output voltage U5 at the output 224 of FIG. 2 over time. The graph also shows a threshold value 310. FIG. 4 also shows the processed current signal 300 and in addition the current signal 400 which is the voltage U1 of FIG. 2 over time.

FIG. 3 illustrates that peaks of the processed current signal 300 can easily be detected by comparing the processed current signal 300 with the threshold value 310. Even large changes of the processed current signal 300, which might occur due to changes of the shaver, will not change the result of the comparison.

FIG. 4 shows the current signal 400 and that makes clear that any peaks are difficult to detect. However, besides the superimposed noise, the DC-portion of the current signal 400 is much bigger that the overlaid characteristics which are associated with hair-cutting actions of the cutting element. Accordingly, any changes of the amplitude of the current signal 400 affect the amplitude of the overlaid characteristics even more.

The suggested solution prevents this problem, because the processed current, inter alia, eliminates the DC-portion.

Figure 6:
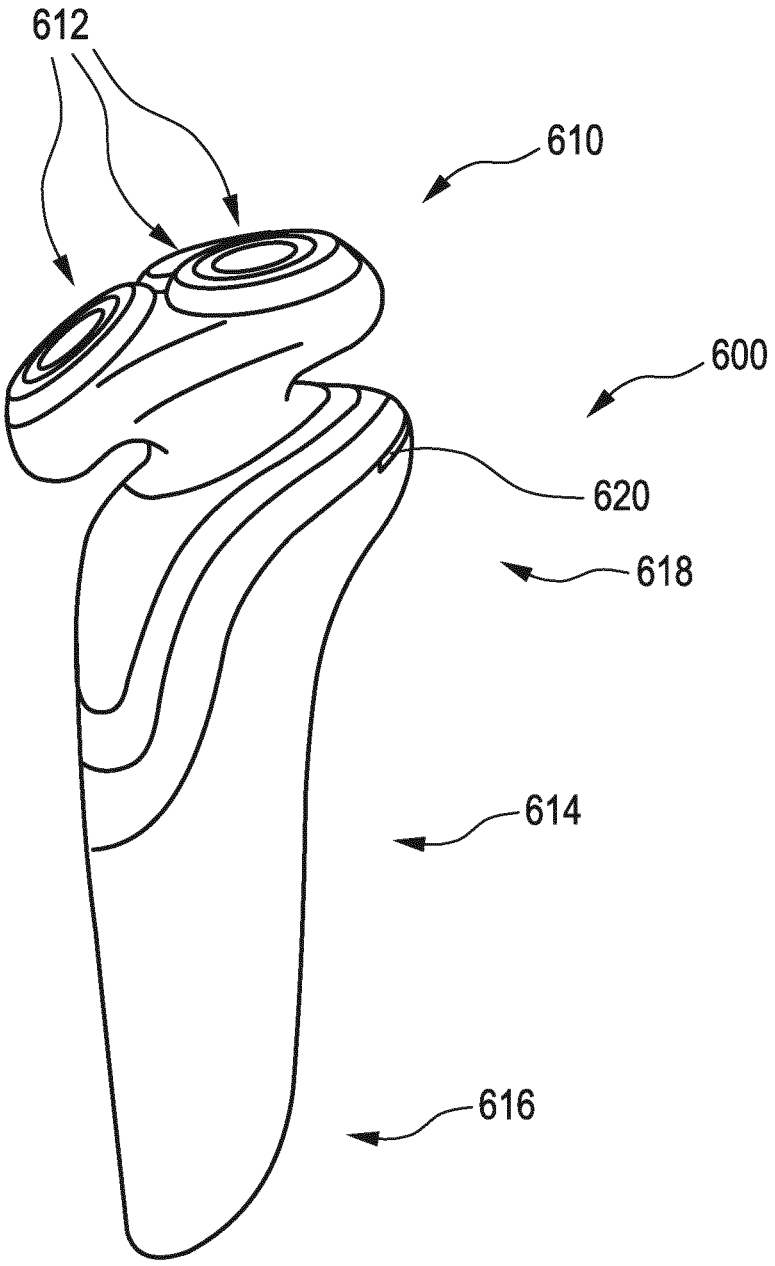
FIG. 6 is a schematic view of a shaver as an example of a hair cutting apparatus.

FIG. 6 shows a hair cutting apparatus 600 having a shaving head 610 comprising a plurality of cutting elements 612. The cutting elements 612 of this embodiment are basically arranged in three groups, each group being prepared to rotate in order to cut hair. The shaving head is attached to a main body 614 of the hair cutting apparatus 600. The main body is also designed to be hand-held by a user when used for shaving.

The main body comprises a lower end 616 and an upper end 618 arranged towards the shaving head 610. At the upper end, in the proximity of the shaving head 610 and thus in the proximity of the cutting elements 612, there is provided a light indicator 620 which is part of a cutting indicator. During use, the light indicator 620 indicates whether hairs are actually being cut or not by the cutting elements 612. When using the hair cutting apparatus 600, the shaving head 610 contacts the skin with the cutting elements 612. While shaving, the user looks at the skin near the shaving head 610 and therefore also looks at the shaving head and, consequently, he sees the light indicator 620 as well. In this way, the user can easily recognize whether hairs are actually being cut and can move the shaver accordingly.

Figure 7:
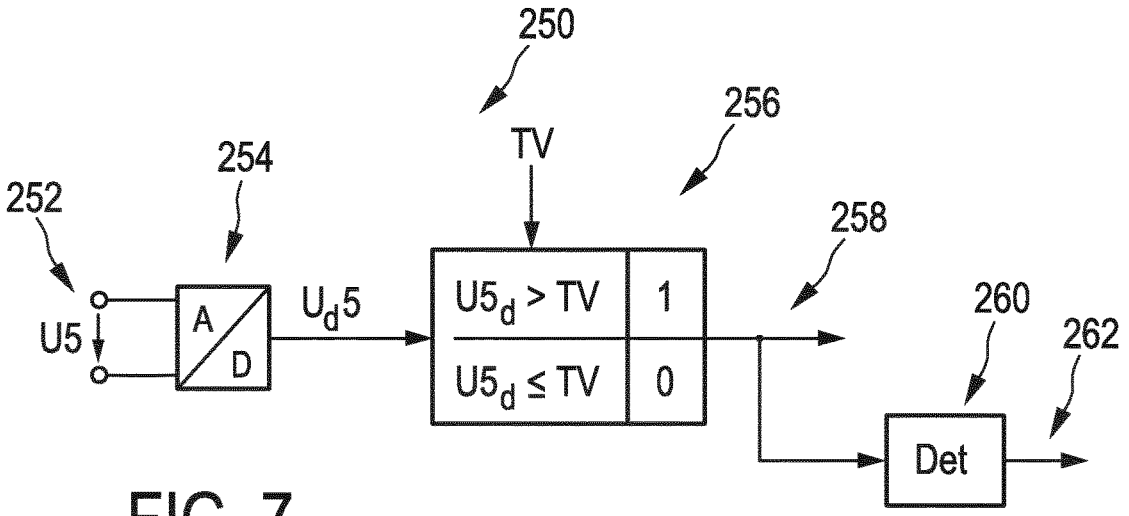
FIG. 7 is an evaluator configured to compare a time derivative signal with a predetermined threshold value.

FIG. 7 shows an evaluator 250 having the output voltage U5 at the output 224 of FIG. 2 as an input voltage at the evaluator input 252. This inputted analogue voltage U5 is converted in the AD-converter 254 into a digital derivative signal $U5_d$ that is inputted in the comparator 256. A predetermined threshold value TV is also inputted in the comparator 256. The comparator compares these values and provides a comparison result at the output 258. That result can be the value "1" if the digital derivative signal $U5_d$ is larger than the predefined threshold value TV, or the result can be the value "0" otherwise. Accordingly, the value "1" at the output 258 of the comparator 256 and thus at the evaluator 250 indicates an operating condition wherein a hair is actually being cut by any of the cutting elements 612.

The output 258 can be used for different purposes. According to the present invention, the output 258 is used to directly control the light indicator 620 such that the light indicator 620 is activated to instantaneously indicate whether or not a hair-cutting action of the cutting elements 612 is actually detected by the hair-cutting detector. This can be realized by configuring the light indicator 620 such that, when the output 258 provides the value "1", the light indicator 620 will be activated and, when the output 258 provides the value "0", the light indicator 620 will not be activated. For this purpose, the light indicator 620 might be provided with suitable electronics having an input for receiving an output signal from the output 258. Alternatively, the light indicator 620 might be configured to be able to generate light of different colors. In such an embodiment, the light indicator 620 is activated in a first color when receiving the value "1" from the output 258 to indicate an actual hair-cutting action, and the light indicator 620 is activated in a second color, different from the first color, when receiving the value "0" from the output 258 to indicate that actually no hairs are being cut. Alternatively, the light indicator 620 might be configured to be able to generate light in a continuous mode as well as in a blinking mode. In such an embodiment, the light indicator 620 is activated to generate light in the continuous mode when receiving the value "1" from the output 258 to indicate an actual hair-cutting action, and the light indicator 620 is activated in the blinking mode when receiving the value "0" from the output 258 to indicate that actually no hairs are being cut.

The output 258 can also be used to additionally detect a progress of a hair-cutting process. For this purpose, the signal of the output 258 is input into a progress determining unit 260 for further processing. The progress determining unit 260 can determine the progress of the hair-cutting process in a particular manner, for example by counting a number of detected hair-cutting actions during a predetermined time interval, or by identifying time intervals between consecutively detected hair-cutting actions. The result of this counting process may provide an indication of the progress of the hair-cutting process. For example, a relatively high number of detected hair-cutting actions during a predetermined time interval or a relatively short time interval between consecutively detected hair-cutting actions may indicate an early stage of the hair-cutting process, whereas a relatively low number of detected hair-cutting actions during a predetermined time interval or a relatively long time interval between consecutively detected hair-cutting actions may indicate a late stage of the hair-cutting process. The progress determining unit 260 might comprise suitable software to provide an output signal at its output 262 indicating the degree of progress of the hair-cutting process. This software might determine the output signal, depending on the signal received from the output 258 of the comparator 256.

The output 262 of the progress determining unit 260, i.e. the degree of progress of the hair-cutting process, may be visualized, by means of the light indicator 620, in different ways. The light indicator 620 may e.g. be provided with a plurality of individual light sources such as LEDs (not shown in the figures), wherein the number of activated individual light sources is dependent on the determined degree of progress of the hair-cutting process. For example, an early stage of the hair-cutting process is indicated by activating all light sources, a late stage of the hair-cutting process is indicated by activating only few light sources or a single light source, while no light source is activated when actually no hair-cutting actions are detected. Any intermediate stage of the hair-cutting process might be indicated by activation of a proportional number of light sources. In an alternative embodiment as described hereinbefore, wherein the light indicator 620 is configured to be activated in two different colors, the light indicator 620 might be configured to provide a fading function, enabling the light generated by the light indicator 620 to gradually change from the first color to the second color depending on the signal received from the output 262 of the progress determining unit 260. In this embodiment, an early stage of the hair-cutting process is indicated by activating the light indicator 620 in the first color. An end stage of the hair-cutting process, wherein no hair-cutting actions are actually being detected, is indicated by activating the light indicator 620 in the second color, while any intermediate stage of the hair-cutting process might be indicated by activating the light indicator 620 in an intermediate color between the first and the second colors. For this purpose, the light indicator 620 might comprise a number of LEDs of different colors.

Figure 8:
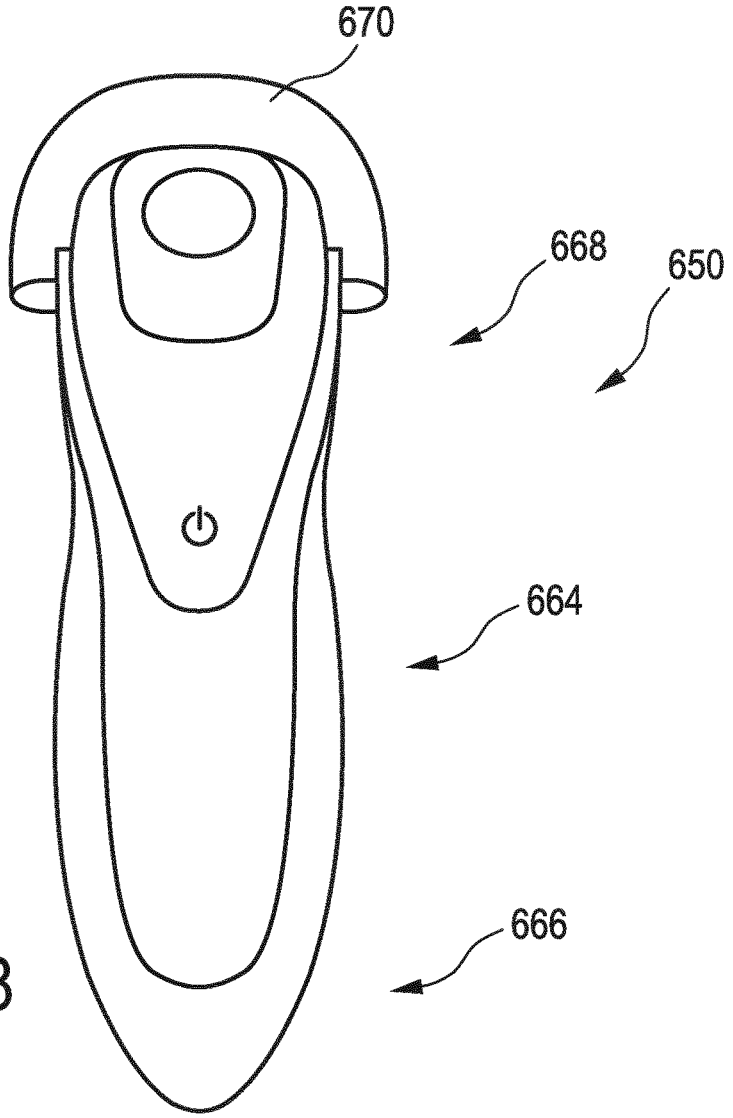
FIG. 8 is a schematic view of a further shaver as an example of a hair cutting apparatus.

FIG. 8 shows a hair cutting apparatus 650 having a main body 664. The main body 664 is also designed to be held by the hand of a user when the apparatus is used for shaving. The main body 664 comprises a lower end 666 and an upper end 668 arranged towards a shaving head which is not shown in this figure. At the upper end 668, in the proximity of the shaving head and thus in the proximity of cutting elements, there is provided a light indicator 670 which is part of a cutting indicator. During use, the light indicator 670 indicates whether hairs are actually being cut or not by the cutting elements. The light indicator 670 has the shape of a partial ring, i.e. it is substantially C-shaped. The light indicator 670 partially surrounds the upper end 668 of the shaver 650. The shaving head and thus the cutting elements are basically right behind the light indicator 670.

Accordingly, one idea is to use filters and an amplifier to make the conventional motor current measurement in shaving and grooming devices more robust. It was found that some functions in a shaver can be improved by a robust current measurement. Such robust current measurement is suggested and used to detect hair-cutting actions or to measure hair density. By using filters and an amplifier the current peaks in the motor current associated with hair-cutting actions can be derived from a noise shaped motor current. This solution is robust enough to reliably detect the current peaks in the motor current associated with hair-cutting actions in case of pollution and in case of using different types of interchangeable shaving or grooming units, such as shaver-type, trimmer-type or brush-type attachments.

It was found that at least one conventional sense resistor motor current measurement used in shaving and grooming devices works as follows. Simple motor current measurement measures the voltage drop across a sense resistor. Such a resistor might have a value of 0.05 Ohm. A microcontroller's AD converter measures the sense resistor voltage drop. The AD converter value, which is a 10-bit value most of the time, is input to measure the absolute motor current by using Ohm's law. The result looks similar to the current signal 400 shown in FIG. 4 and is evaluated by analyzing it.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit or device may fulfill the functions of several items recited in the claims. The mere fact that certain measures are recited in mutually different dependent claims does not indicate that a combination of these measures cannot be used to advantage.

An improvement or replacement of such measurement is suggested and that can particularly be used for an appliance that has a light ring or divided light ring to show the cutting of the beard. Such an appliance is suggested. The suggested solution uses the motor current to detect the cutting torque. To make this function robust, it is suggested to make the conventional motor current measurement more robust to slow torque changes caused by wear, unit replacement and pollution of the shaving system.

Any reference signs in the claims should not be construed as limiting the scope.

This solution particularly provides a suggestion to overcome the problem of setting a threshold level for motor current detection in appliances.

The suggested solution is an improvement to solutions which are tailored to an exact system and which do not consider variations in motor current for each shaver or groomer. It was found that it is difficult to set a threshold level in the current because of variation in torque of shaving systems due to pollution, friction differences or wear.

The suggested solution can particularly be used in male skin care products, shavers, grooming devices and hair clippers.

The invention claimed is:

1. A hair cutting apparatus comprising:

a cutting element configured to cut hair;

a motor configured to drive the cutting element for cutting the hair when powered by a motor current;

a hair-cutting detector configured to detect a hair-cutting action of the cutting element; and a cutting indicator configured to indicate the detected hair-cutting action of the cutting element, wherein the cutting indicator comprises a light indicator controlled by the hair-cutting detector and configured to be activated to instantaneously indicate whether the hair-cutting action of the cutting element is detected by the hair-cutting detector, and wherein the light indicator is configured to blink to indicate that the hair-cutting action is not being detected.

2. The hair cutting apparatus according to claim 1, wherein the light indicator is arranged in the proximity of the cutting element.

3. The hair cutting apparatus according to claim 1, wherein the light indicator has the shape of a partial ring.

4. A hair cutting apparatus comprising:

a cutting element configured to cut hair;

a hair-cutting detector configured to detect hair-cutting actions of the cutting element; and a processor configured to determine a status of progress of a hair-cutting process, based on the detected hair-cutting actions.

5. The hair cutting apparatus according to claim 1, wherein the light indicator is adapted to be activated in at least in a first color and a second color different from the first color, and wherein the hair-cutting detector is adapted to control the light indicator such that the first color is instantaneously generated when the hair-cutting action is detected and the second color is instantaneously generated when the hair-cutting action is not detected.

6. The hair cutting apparatus according to claim 5, wherein the hair-cutting detector is configured to provide a fading function for the light indicator, enabling light generated by the light indicator to gradually change from the first color to the second color when the hair-cutting detector detects a decreasing number of hairs being cut during a predetermined time interval.

7. The hair cutting apparatus according to claim 4, comprising a light indicator having a plurality of light elements, wherein the processor is configured to individually control the plurality of light elements to indicate the status of progress of the hair-cutting process by a number of the plurality of light elements being activated.

8. The hair cutting apparatus according to claim 1, wherein the hair-cutting detector comprises a current detector configured to detect the motor current as a function of time, the current detector comprising:

a current sensor configured to sense the motor current and to provide a current signal indicative of the sensed motor current; and a current manipulator configured to determine a time derivative signal of the current signal, wherein the current manipulator comprises an evaluator configured to detect whether the time derivative signal or an amplified signal of the time derivative signal is above a predetermined threshold value to detect the hair-cutting action of the cutting element.

9. The hair cutting apparatus according to claim 8, wherein the current manipulator comprises a high-pass filter adapted to determine the time derivative signal of the current signal.

10. The hair cutting apparatus according to claim 8, comprising a drive system coupling the motor to the cutting element, wherein the current manipulator comprises a low-pass filter configured to eliminate high frequency components of the current signal caused by torque changes of the drive system.

11. The hair cutting apparatus according to claim 8, wherein the current manipulator comprises an operational amplifier configured to amplify the time derivative signal into the amplified signal, and wherein the current manipulator comprises a high-pass filter configured to differentiate the amplified signal to eliminate a DC-offset of the amplified signal.

12. The hair cutting apparatus according to claim 8, wherein:

the current sensor is provided as an analogue electric circuitry, the current manipulator is provided as an analogue electrical circuitry comprising an operational amplifier, and the evaluator is provided as a digital processor.

13. A method for indicating a hair-cutting process of a hair cutting apparatus including a cutting element configured to cut hair, a motor configured to drive the cutting element for cutting the hair when powered by a motor current, a hair-cutting detector, and a light indicator, wherein the method comprises acts of:

detecting a hair-cutting action of the cutting element by the cutting detector; and in response to the detecting act, controlling the light indicator by the hair-cutting detector to instantaneously activate the light indicator.

14. The method according to claim 13, wherein the detecting act comprises acts of sensing a motor current of the motor by using a current sensor and providing a current signal as a function of time indicative of the sensed motor current, determining a time derivative signal of the current signal using a current manipulator;

detecting whether the time derivative signal or an amplified signal of the time derivative signal is above a predetermined threshold value to detect a hair-cutting action of the cutting element, using an evaluator;

eliminating high frequency components of the current signal caused by torque changes of a drive system coupling the motor to the cutting element by using a first low-pass filter providing a first filtered signal;

determining a time derivative signal of the first filtered signal by using the first high-pass filter;

amplifying the time derivative signal into an amplified signal by using an operational amplifier;

differentiating the amplified signal by using a second high-pass filter to eliminate a DC-offset of the amplified signal; and eliminating a residual high-frequent noise of the differentiated amplified signal by using a second low-pass filter to provide a processed current signal.

15. A hair cutting apparatus comprising:

a cutting element configured to cut hair;

a motor configured to drive the cutting element for cutting the hair when powered by a motor current;

a hair-cutting detector configured to detect a hair-cutting action of the cutting element; and a cutting indicator configured to indicate the detected hair-cutting action of the cutting element, wherein the cutting indicator comprises a light indicator controlled by the hair-cutting detector and configured to be activated in response to the detected hair-cutting action.

16. The hair cutting apparatus of claim 15, wherein the light indicator is configured to blink to indicate that the hair-cutting action is not being detected.

17. The hair cutting apparatus of claim 15, comprising a processor configured to determine a status of progress of a hair-cutting process, based on the detected hair-cutting action.

18. The hair cutting apparatus of claim 15, comprising a processor configured to determine a status of progress of a hair-cutting process by one of:

counting a number of detected hair-cutting actions during a predetermined time interval, and identifying time intervals between consecutively detected hair-cutting actions.

19. The hair cutting apparatus of claim 15, wherein the light indicator is configured to be activated in at least in a first color and a second color different from the first color, and wherein the hair-cutting detector is configured to control the light indicator such that the first color is generated when the hair-cutting action is detected and the second color is generated when the hair-cutting action is not detected.

20. The hair cutting apparatus of claim 15, wherein the hair-cutting detector comprises a current detector configured to detect the motor current as a function of time, the current detector comprising:

a current sensor configured to sense the motor current and to provide a current signal indicative of the sensed motor current; and a current manipulator configured to determine a time derivative signal of the current signal, wherein the current manipulator comprises an evaluator configured to detect whether the time derivative signal or an amplified signal of the time derivative signal is above a predetermined threshold value to detect the hair-cutting action of the cutting element.

* * * * *